United States Patent [19]

Eschmann et al.

[11] Patent Number: 4,508,504

[45] Date of Patent: Apr. 2, 1985

[54] BLAST HEATING APPARATUS FOR BLAST FURNACES

[75] Inventors: Friedrich Eschmann, Ginsheim-Gustavsburg; Günter Gelsdorf, Nordenstadt; Peter Nold, Rümmelsheim; Gotthard Staats, Rehlingen; Gerhard Subat, St. Augustin, all of Fed. Rep. of Germany

[73] Assignee: Didier-Werke AG, Wiesbaden, Fed. Rep. of Germany

[21] Appl. No.: 492,001

[22] Filed: May 5, 1983

[30] Foreign Application Priority Data

May 14, 1982 [DE] Fed. Rep. of Germany ..... 3218126

[51] Int. Cl.[3] ..... F27B 14/08

[52] U.S. Cl. ..... 432/217; 432/248; 432/251; 432/247

[58] Field of Search ..... 432/247, 28, 248, 30, 432/251, 40, 252, 216, 217; 110/336, 340

[56] References Cited

U.S. PATENT DOCUMENTS

| | | | |
|---|---|---|---|
| 1,461,357 | 7/1923 | Kling | 432/217 |
| 1,771,306 | 7/1930 | Nelson | 432/217 |
| 2,187,191 | 1/1940 | Younglove | 432/217 |
| 2,478,293 | 8/1949 | MacDonald | 432/217 |
| 3,204,939 | 9/1965 | Ipsen | 432/251 |
| 3,528,647 | 9/1970 | Hyde | 432/217 |
| 4,005,982 | 2/1977 | Palz et al. | 432/248 |
| 4,022,573 | 5/1977 | Kuntziger | 432/30 |
| 4,290,751 | 9/1981 | Malone et al. | 432/217 |

*Primary Examiner*—Henry C. Yuen

*Attorney, Agent, or Firm*—Wenderoth, Lind & Ponack

[57] ABSTRACT

A blast heating apparatus includes an inner metal shell having therein a refractory lining. An outer metal shell surrounds at least a portion of the inner metal shell and defines therewith a double shell structure. Spacers are positioned between the outer and inner metal shells to define therebetween a gap. At least a portion of such gap is filled with a pourable dry material having a grain size of up to 8 mm and a heat conductivity of at least approximately 1.5 W/Km.

10 Claims, 3 Drawing Figures

BLAST HEATING APPARATUS FOR BLAST FURNACES

BACKGROUND OF THE INVENTION

The present invention is directed to a blast heating apparatus, particularly for blast furnaces, of the type including an inner metal shell, for example a shell formed of sheet iron, for example by welding together plural sheet iron courses, having positioned therein a refractory fireproof lining.

It is known that modern blast heating apparatus, which operate with relatively high dome temperatures of up to 1600° C. and hot blast pressures of up to 4 bar, suffer from intercrystalline tension crack corrosion problems. In many cases, the sheet iron shell surrounding the fireproof lining is damaged prematurely to such an extent that for reasons of operational safety a lower dome temperature has to be used to prevent damage and/or prevent shut-down of the blast heating apparatus. This lower operating temperature reduces the efficiency of the entire installation. It generally is considered that the cause of such intercrystalline tension crack corrosion is the occurrence of nitrates under tensile stress, which lead to the formation of cracks in the surface of the metal shell.

West German DE-OS No. 27 42 109 deals with the problem of tension crack corrosion and indicates that such phenomenon may be avoided by the provision of a protective shell which is welded to the inside wall of the main or first shell and which is elastically deformable under thermal and mechanical stresses. Preferably, this protective shell is formed of a high alloy special steel material. Due to the interior installation of the protective shell with regard to the main or first shell, this solution primarily is intended for new constructions, and this system can be employed in existing blast heating apparatus only at great costs.

SUMMARY OF THE INVENTION

With the above discussion in mind, it is the object of the present invention to provide an effective system for protecting a blast heating apparatus against tension crack corrosion by relatively simple structure incorporating a double shell structure.

It is a further object of the present invention to provide such a system which easily can be installed in existing blast heating structures.

It is a more specific object of the present invention to provide an improved blast heating apparatus, particularly for blast furnaces, including a double shell structure having a construction whereby it is possible to avoid the prior art tension crack corrosion phenomenon, as well as other prior art disadvantages.

These objects are achieved in accordance with the present invention by the provision of a blast heating apparatus, particularly for blast furnaces, of the type including an inner or normal metal shell having therein a conventional refractory lining. An outer metal shell surrounds at least a portion of the inner metal shell and defines therewith a double shell structure. Spacers are positioned between the outer and inner metal shells and define therebetween a gap. At least a portion of this gap is filled with a pourable dry material having a grain size of up to 8 mm and a heat conductivity of at least 1.5 to 2.5 W/Km [DEM SI System International; 1 W/Km=1163 KCal/(sec)(cm)(°C.)]. The pourable dry material preferably comprises a dry mass or mixture of SiC and graphite material. The spacers define a gap of approximately from 15 to 40 mm and are of sufficiently strong material, preferably metal material, to maintain such gap dimension. By this structural arrangement, the metal shell, for example a sheet iron shell, is protected against intercrystalline tension crack corrosion by simple structure, or can be treated subsequently. Any particular area of the blast heating apparatus which is particularly subject to such corrosion can be protected in this manner. The double shell structure, which itself is substantially without thermal stress, primarily due to the relatively high heat conductivity of the dry material compacted to at least 1.7 kg/dm$^3$, results in an even temperature field or distribution along the double shell structure.

Both the inner shell and the outer shell are formed of conventional metal materials, for example sheet iron, normally employed in the blast heating apparatus art.

The pourable dry material may be any such material which would be understood by those skilled in the art to provide the desired relief from thermal stress and even temperature field or distribution on the double shell structure. One particular composition of such dry material which has proven particularly successful in operation includes 80% by weight SiC-graphite mixture, 5% by weight MgO and 15% by weight $BaSO_4$. In this specific example, the composition of the dry pourable material includes 30% by weight SiC and 50% by weight graphite. However, other relative proportions of the SiC and graphite within the mass or mixture are contemplated as being within the scope of the present invention. Generally, the mass or mixture may include 5 to 95% by weight SiC and 5 to 95% by weight graphite.

Furthermore, even though such dry material generally satisfactorily protects the shell from aggressive agents, it is of additional advantage to specifically protect the inner surface of the outer metal shell against such aggressive agents. In accordance with the present invention this may be achieved by the provision of an acidproof coating having an epoxy resin base on the inside surface of the outer metal shell. The outer metal shell generally is formed of plural metal members joined at welded seams. In accordance with a further aspect of this feature of the present invention, the inner portions of such welded seams may be covered by welding strips, for example of a suitable metal or other material. Furthermore, the inner portions of the welded seams, as well as the welding strips, may be covered with an acidproof casting mass having an epoxy resin base. Such casting mass may be formed of any suitable material, as well be apparent to those skilled in the art, having a suitable degree of the property of being resistant to aggressive agents and the suitable refractory property. One particularly suitable such composition of the casting mass includes 11% by weight epoxy resin, e.g. bisphenol-A type, 13% by weight tar with hardener, e.g. cycloaliphatic type, and 76% by weight granular quartz. Those skilled in the art will understant what other, and more specific, types of epoxy resins, tars, and hardeners which may be employed to achieve the above mentioned necessary properties. In such composition, preferably one-half of the quartz has a grain size of up to 1 mm, and one-half of the quartz has a grain size above 1 mm, and preferably may be in the form of generally round grains.

In one particularly advantageous embodiment of the double shell structure, the welded seams include vertical welded seams, and the spacers are positioned to extend vertically on opposite lateral sides of each vertical welded seam, with the casting mass being poured or cast into portions of the gap between adjacent of the spacers, thereby to cover the inner portions of the vertical welded seams. This arrangement facilitates the backfilling operation with different materials, i.e. the casting mass and the pourable dry material. Furthermore, each spacer may have a generally U-shaped transverse configuration defining a spacer channel, and the casting mass may be poured or cast into such channel.

In a further preferred feature according to the present invention, the outer shell member includes plural vertically spaced or stacked courses of metal members joined by horizontal welded seams. The gap between the inner metal shell and the uppermost such course of the outer metal shell is filled completely by the casting mass, and does not include any of the pourable dry material. Closable inlets and vents extend through the uppermost course. This construction has proven to be particularly resistant and efficient, both during construction and during operation.

BRIEF DESCRIPTION OF THE DRAWINGS

Other objects, features and advantages of the present invention will become more apparent from the following detailed description of a preferred embodiment thereof, with reference to the accompanying drawings, wherein.

DETAILED DESCRIPTION OF THE INVENTION

Figure 1:
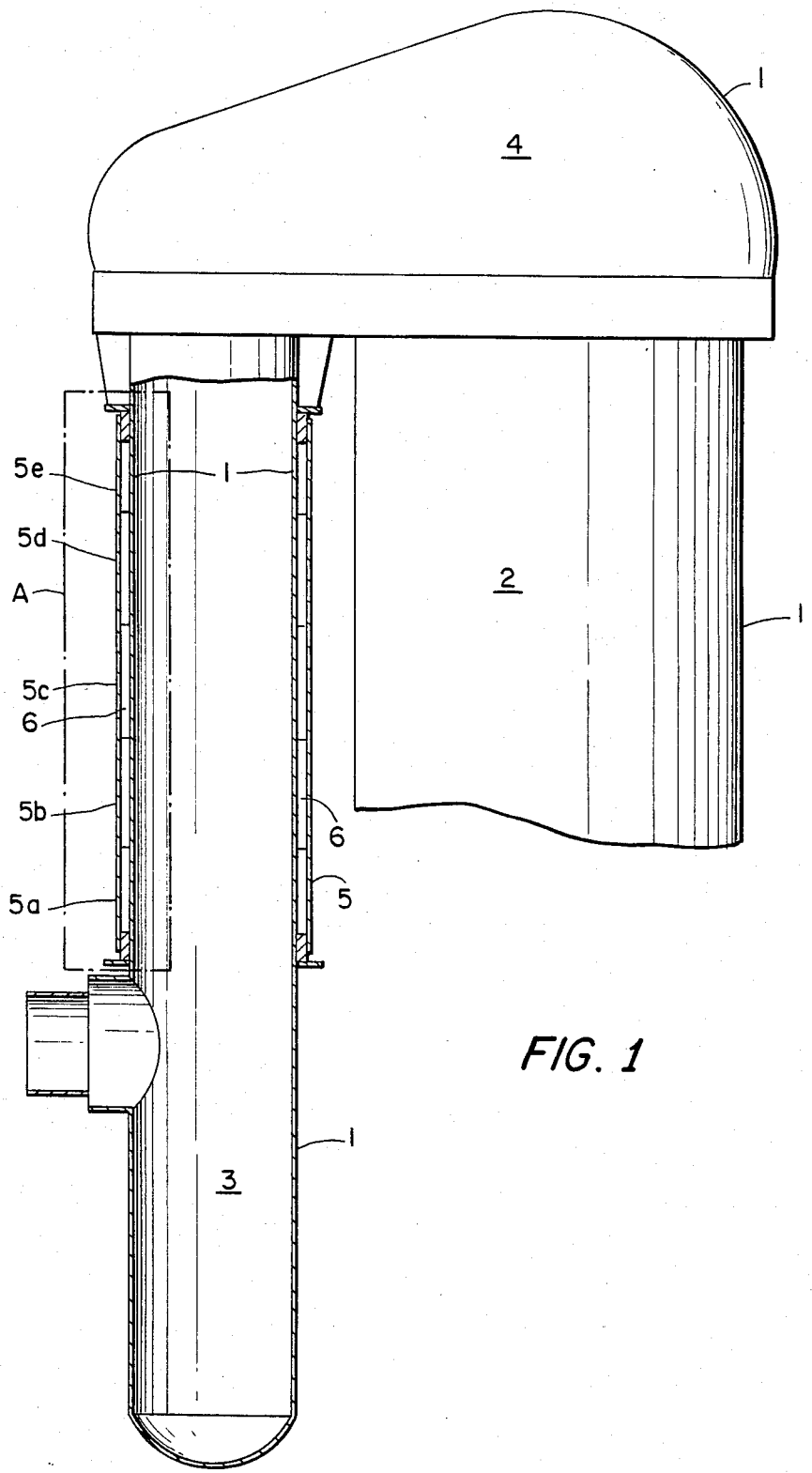
FIG. 1 is a somewhat schematic view, partially in cross section, of a blast heating apparatus, a portion of which is constructed in accordance with the present invention.
Figure 2:
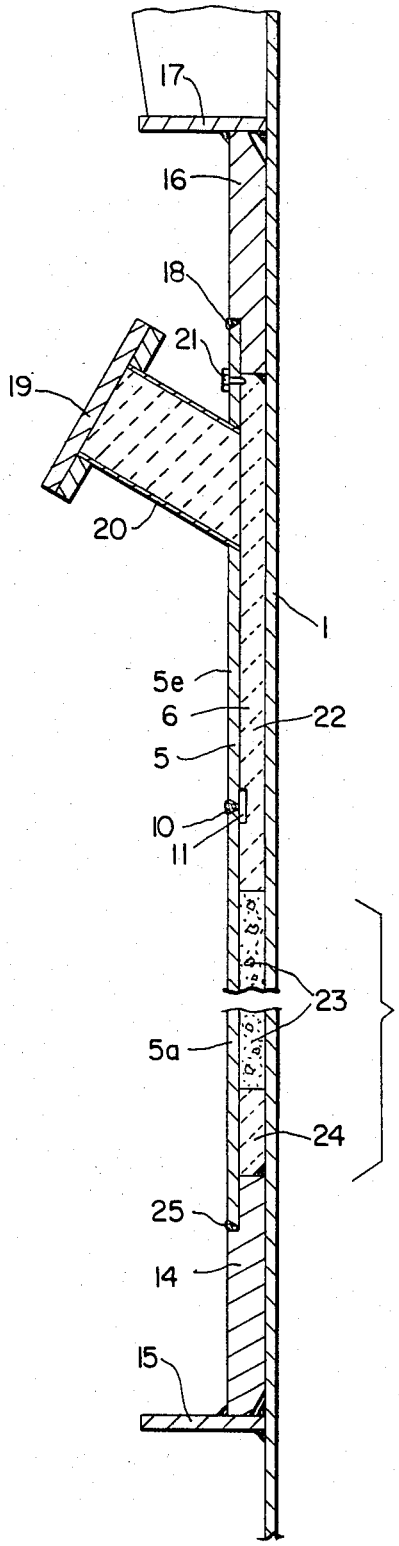
FIG. 2 is an enlarged view of that portion of FIG. 1 enclosed in dash-dot lines and indicated as A.

With reference now to the drawings, there is shown schematically therein a normal metal shell 1, for example formed of sheet iron, of an otherwise known blast heating apparatus. Shell 1 covers conventional structure such as a grate chamber 2, a combustion chamber 3, and a connecting dome 4 of a blast heating apparatus with an outside combustion chamber. Such blast heating apparatus includes a conventional fireproof refractory lining within the shell 1, but such lining is not shown in the drawings for purposes of simplicity of illustration.

In accordance with the present invention, at least a portion of inner shell 1, which as is known is formed of plural shell courses, is provided with a second or outer metal shell 5. In the illustrated arrangement, the double shell structure formed by inner shell 1 and outer shell 5 is formed at combustion chamber 3 where the flame burns up during a heating-up phase of the checkerwork in the grate chamber 2. It however is intended to be within the scope of the present invention to provide such double shell structure at other and/or different portions of the blast heating apparatus.

Figure 3:
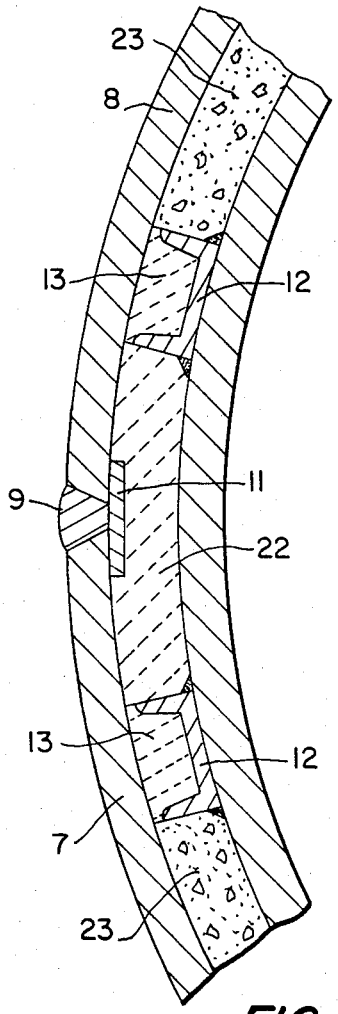
FIG. 3 is a further enlarged partial transverse cross-sectional view through a vertical welded seam of the structure of FIG. 2.

Between the shells 1 and 5 of the double shell structure there is formed a gap 6. The construction of outer shell 5, similar to that of inner shell 1, consists of plural shell courses **5*a* to 5*e*, one on top of the other. Each shell course in turn is formed of two semicircular segments 7 and 8, as illustrated in FIG. 3, joined by vertical welded seams 9. The courses 5*a* to 5*e* respectively are joined by horizontal welded seams 10. All joints are connected through the welded seams 9 and 10 by backing them with welding strips 11, for example strips formed of metal or other suitable material. The gap 6 between the shells 1 and 5 is defined by plural spacers 12, preferably vertically extending, and preferably the spacers 12 are positioned on opposite lateral sides of each vertical seam 9. The pair of spacers 12 on opposite sides of each vertical seam 9 define, as illustrated in FIG. 3, a gap portion which is filled by a casting mass 22. Furthermore, in a preferred arrangement the spacers 12 have a transverse generally U-shaped cross section defining a vertical spacer channel which also is filled by an elastic binding casting mass 13. Casting masses 22 and 13** preferably are of the same material and composition.

At the lower end of the double shell structure, the outer shell 5 rests on a base ring 14 and is connected thereto by a horizontal welding seam 25. Base ring 14 is welded to a ring bracket 15 which is welded to inner shell 1. Similarly, at the top of the double shell structure, a top ring 16 is welded to a ring bracket 17 which is welded to inner shell 1. Top ring 16 is connected to the outer shell 5 by means of a horizontal welded seam 18. The upper end or course of outer shell 5 has inlets 20 which can be closed by means of flanges or covers 19, and vents 21 are located at the highest point of gap 6, into which the filling openings of inlets 20 extend. Preferably, inlets 20 and vents 21 each are spaced evenly around the circumference of shell 5.

The gap 6 between shells 1 and 5 is filled with two types of filling materials. One such filling material is the casting mass 13, 22 which is chemically binding, acidproof, refractory, and capable of being casted. Those skilled in the art will understand what specific materials may be employed to achieve these properties. The other filling material 23 is a dry pourable material providing suitable heat conductivity properties. The acidproof casting mass 22, 13 is poured along welded seams 9 and 10, to thereby protect such seams against aggressive agents, while the dry material 23 fills all other intermediate areas between the shells.

Backfilling of the two materials 22, 13 and 23 may be done in batches. Thus, following the installation of the lower outer shell course **5*a*, a bottom layer 24 of casting mass 22 is first poured and cast, whereby the welded seams between vertical spacers 12 is kept free. Following hardening of this casting mass, dry material 23 is filled onto bottom cast layer 24, for example with the aid of vibrators, until the dry material 23 reaches a suitable level below the upper edge of course 5*a*, for example approximately 150 mm below such upper edge. Thereafter, the vertical welded seam areas between spacers 12 are filled with casting mass 22, 13 to the top of course 5*a*. Thereafter, the second course 5*b* is assembled, and casting mass 22 is filled onto the top of the previously filled dry material 23 up to a suitable level above the horizontal welded seam 10 connecting courses 5*a*, 5*b*. Thus, this casting mass may be cast up to approximately 150 mm above such horizontal welded seam. As soon as this casting mass has hardened, the previously described steps are repeated. The last or upper course 5*e*, which may be mounted without spacers 12, is filled entirely with the casting mass. The filling operation will be complete when the casting mass flows out of vents 21**. By the above construction, it is possible to protect the shell structure from intercrystalline tension crack corrosion.

Although the present invention has been described and illustrated with respect to particularly preferred features thereof, it is to be understood that various modifications and changes may be made without departing from the scope of the present invention. Particularly, it is to be understood that although preferred examples of the various materials employed in the present invention have been given, it is not intended that the present invention be limited to such specific materials. Rather, it is intended that the present invention encompass other materials achieving similar properties, as will be apparent to those skilled in the art.

We claim:

1. In a blast heating apparatus, particularly for blast furnaces, of the type including an inner metal shell having therein a refractory lining, the improvement comprising:

an outer metal shell surrounding at least a portion of said inner metal shell and defining therewith a couble shell structure;

spacers positioned between said outer and inner metal shells and defining therebetween a gap; and at least a portion of said gap being filled with a pourable dry material having a grain size of up to 8 mm and a heat conductivity of at least approximately 1.5 W/Km, said pourable dry material comprising a dry mass consisting essentially of 80% by weight of a SiC-graphite mixture, 5% by weight MgO, and 15% by weight $BaSO_4$.

2. The improvement claimed in claim 1, further comprising an acidproof coating having an epoxy resin base on the inside surface of said outer metal shell.

3. The improvement claimed in claim 1, wherein said outer metal shell is formed of plural metal members joined at welded seams, and further comprising welding strips covering inner portions of said welded seams.

4. The improvement claimed in claim 3, wherein portions of said gap adjacent said welded seams are filled with an acidproof casting mass having an epoxy resin base and covering said welding strips.

5. In a blast heating apparatus, particularly for blast furnaces, of the type including an inner metal shell having therein a refractory lining, the improvement comprising:

an outer metal shell surrounding at least a portion of said inner metal shell and defining therewith a double shell structure, said outer metal shell being formed of plural metal members joined at welded seams;

welding strips covering inner portions of said welded seams;

spacers positioned between said outer and inner metal shells and defining therebetween a gap;

at least a portion of said gap being filled with a pourable dry material having a grain size of up to 8 mm and a heat conductivity of at least approximately 1.5 W/Km; and portions of said gap adjacent said welded seams being filled with an acidproof casting mass having an epoxy resin base and covering said welding strips, said casting mass comprising 11% by weight epoxy resin, 13% by weight tar with hardener, and 76% by weight granular quartz.

6. The improvement claimed in claim 5, wherein one-half of said quartz has a grain size of up to 1 mm, and one-half of said quartz has a grain size above 1 mm in the form of generally round grains.

7. The improvement claimed in claim 5, wherein said welded seams include vertical welded seams, said spacers are positioned to extend vertically on opposite lateral sides of said vertical welded seams, and said casting mass is cast into portions of said gap between adjacent said spacers.

8. The improvement claimed in claim 7, wherein each said spacer has a generally U-shaped transverse configuration defining a spacer channel, and said casting mass is cast into said channel.

9. The improvement claimed in claim 5, wherein said outer shell member includes plural vertically spaced courses joined by horizontal said welded seams, and said gap between said inner metal shell and the uppermost said course is filled completely by said casting mass.

10. The improvement claimed in claim 9, further comprising closeable inlets and vents extending through said uppermost course into said gap.

* * * * *